United States Patent [19]

Andersson

[11] Patent Number: 4,543,003

[45] Date of Patent: Sep. 24, 1985

[54] PAPER ALIGNMENT DEVICE FOR A PRINTER, TYPEWRITER OR LIKE OFFICE MACHINE

[75] Inventor: Leif H. Andersson, Blåmesvägen, Sweden

[73] Assignee: Facit Aktiebolag, Atvidaberg, Sweden

[21] Appl. No.: 556,241

[22] PCT Filed: Mar. 4, 1983

[86] PCT No.: PCT/SE83/00071

§ 371 Date: Oct. 27, 1983

§ 102(e) Date: Oct. 27, 1983

[87] PCT Pub. No.: WO83/03076

PCT Pub. Date: Sep. 15, 1983

[51] Int. Cl.[4] ..... B41J 13/28

[52] U.S. Cl. ..... 400/632; 271/246

[58] Field of Search ..... 400/632, 632.1, 630, 400/631; 271/242, 243, 244, 245, 246, DIG. 9, 233; 270/59; 493/419, 420, 421, 465

[56] References Cited

U.S. PATENT DOCUMENTS

| | | | |
|---|---|---|---|
| 1,300,235 | 4/1919 | Anderson | 271/243 X |
| 4,346,880 | 8/1982 | Roller et al. | 271/DIG. 9 |
| 4,442,769 | 4/1982 | Kallin | 271/246 X |

FOREIGN PATENT DOCUMENTS

| | | | |
|---|---|---|---|
| 2222690 | 11/1973 | Fed. Rep. of Germany | 400/632 |
| 2716396 | 10/1978 | Fed. Rep. of Germany | 400/632 |

*Primary Examiner*—Edgar S. Burr
*Assistant Examiner*—Charles A. Pearson

[57] ABSTRACT

A paper alignment device for a printer, typewriter or like office machine comprising a friction drive for advancing a sheet of paper in opposite directions past a printing head wherein an alignment mechanism is adapted to co-act with the friction drive to align the sheet of paper from the time when it is about to be released from the friction drive until it has been released and also for generating a force to return the sheet to renewed engagement with the friction drive when the latter has been stopped in preparation for drive of the sheet in the opposite direction.

8 Claims, 3 Drawing Figures

PAPER ALIGNMENT DEVICE FOR A PRINTER, TYPEWRITER OR LIKE OFFICE MACHINE

FIELD OF THE INVENTION

The present invention relates to printers, typewriters and like office machines and particularly to a paper alignment device for such a machine.

BACKGROUND ART

In a printer provided with a paper magazine, the magazine is often arranged above the printer. A sheet of paper from the magazine must be conveyed a comparatively long distance before it has reached a position where printing starts in the printer. There is utilized for the conveyance a friction drive means arranged between the magazine and the start-of-print position, and said friction drive means may obtain advancing assistance from a friction drive means arranged in the magazine. Aligning the sheet, i.e. adjusting it so that its side edges run parallel to the advancing direction of the sheet, often takes place in conjunction with the entrance of the sheet into the machine against drive and back-up rolls situated in the upper part of the machine. When the printing start position is considerably further down in the machine, it may occur, in spite of the alignment, that the sheet becomes somewhat askew due to uneven advancing when it has arrived at said position. In order to avoid such skewing of the sheet or at least minimize it, alignment should take place as close to the printing position as possible.

SUMMARY OF THE INVENTION

An object of the invention is thus to obviate the above-mentioned inconveniences and provide a paper sheet feed device, which is situated and implemented such that effective alignment of a sheet of paper in a region adjacent the printing position is achieved with the utilization of simple means.

In order to satisfy the above and further objects of the invention, there is contemplated printing apparatus which comprises a printing head, friction feed means located upstream of said printing head for feeding sheet material to said printing head and therepast to achieve printing on said sheet material in one direction and for feeding sheet material in opposite direction past said printing head with said feed means being halted between reversal of feed direction and alignment means located downstream of said printing head for engaging said sheet material to align said sheet material from the time when it is about to be released from the friction feed means until it has been released and for returning the sheet material into renewed engagement with said friction feed means when the latter has been stopped in preparation for feeding the sheet material in opposite direction.

BRIEF DESCRIPTION OF THE DRAWINGS

The invention will now be described in detail in conjunction with two embodiments and with reference to the appended drawings, in which.

DETAILED DESCRIPTION OF PREFERRED EMBODIMENTS

Figure 1:
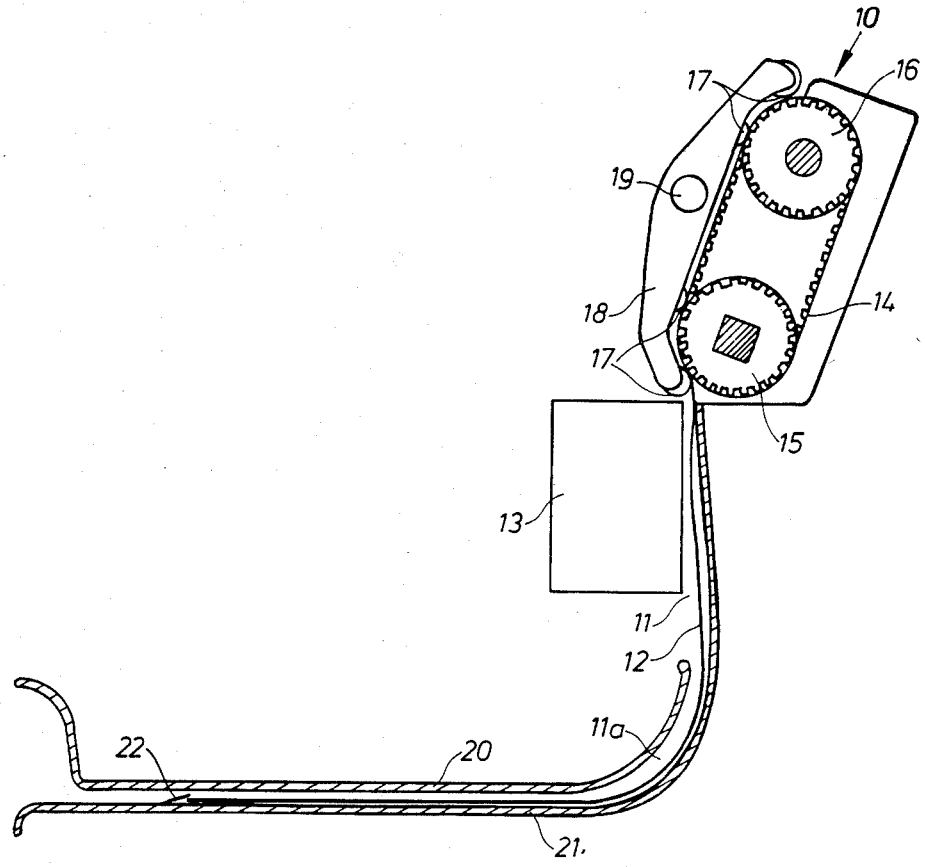
FIG. 1 schematically illustrates a paper advancing system extending from a printer and including an aligning device in the form of a fixed stop.

The paper advancing system in FIG. 1, includes a friction drive means 10 and a paper chute 11 for guiding a sheet 12 of paper past a printing head 13. The friction drive means comprises a toothed belt 14 running around a drive roller 15 and a tension roller 16. Four backup rolls 17 urge the sheet towards the smooth side of the belt. The rolls 17 are arranged in a holder 18 pivotably mounted on a shaft 19. The paper chute has a vertical extension in the region of the printing head 13, and via a curved portion 11*a* continues into a horizontal portion bounded by an upper defining wall 20 and a lower defining wall 21. An aligning means in the form of an edge element 22 extends at right angles to the advancing direction of the sheet.

Aligning a sheet of paper is accomplished in the following manner.

The sheet, assumed to come from an unillustrated paper magazine, is fed by driving means incorporated in said magazine into the space between the timing drive belt 14 and the uppermost backup roll 17. Suitably, the sheet is roughly aligned in this position. The drive roll 15 now begins to rotate and advance the sheet into engagement against the edge element 22. The latter is situated such that when the forward end of the sheet has arrived at it, the back end of the sheet has not entirely come out of engagement with the belt 14 and the lowest backup roll. The result will be that the sheet will be somewhat curved when it has completely left the friction drive means, a force being generated which tends to return the back end of the sheet into the space between the belt and the lowest roll. By mounting the edge element 22 with an accurate location and direction very fine alignment of the sheet is obtained, especially as the returning force assures that the alignment is not lost when the friction drive means begins advancing the sheet in the opposite direction in conjunction with recording information thereon.

Figure 3:
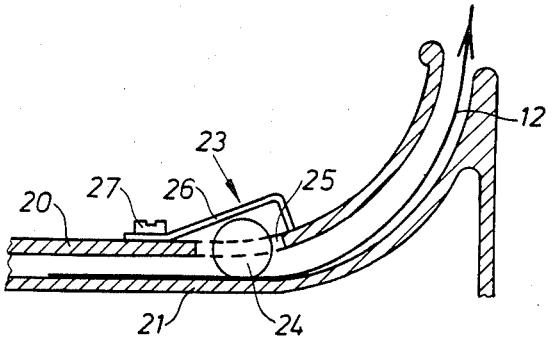
FIGS. 2 and 3 illustrate a modified aligning device in the form of a braking means including a rotatable roll.
Figure 2:
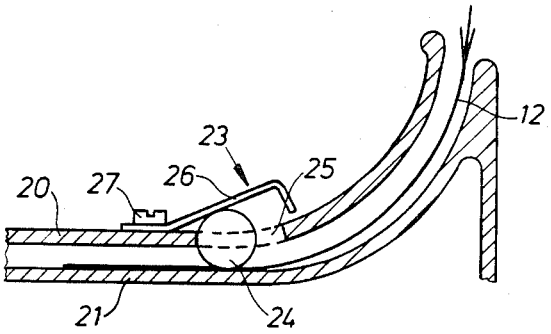

The embodiment according to FIG. 1 has the disadvantage that the fixed stop only allows alignment of one paper format. If it is desired to utilize the alignment device for different paper formats, it is necessary to arrange several stops as well as guide means for activating the correct stop after detecting the paper format. An alternative solution is illustrated in FIGS. 2 and 3, where the fixed stop has been replaced by a braking means 23, allowing the sheet to pass while being retarded until the back edge of the sheet has left the friction drive means. The braking force is used here as the returning force for the sheet. The braking means includes a rotatable body, and in the example this is constituted as a roll 24 oriented at right angles to the advancing direction of the sheet. The roll engages against the bottom wall 21 of the paper chute, or runs against a sheet 12 lying between the roll and wall 21. The roll is disposed in an aperture 25 in the upper defining wall 20, and is retained in the aperture by a flat spring 26 fastened by a screw 27 to wall 20. The spring 26 forms a wedge-shaped space together with the bottom defining wall 21, said space being formed such that the roll exerts a predetermined braking force on the sheet without stopping it when wedged in said space. When the sheet is advanced in the opposite direction, the roll is urged out of the wedge-shaped space and becomes unwedged whereby the braking effect ceases. In FIGS. 2 and 3 the advancing direction of the sheet 12 is illustrated by arrows at the ends thereof.

A printer of the illustrated kind suitably has two friction drive means 10, symmetrically placed relative to the center line of the paper as seen in the advancing direction. In this case, the braking means is suitably arranged according to FIGS. 2 and 3 such that the roll engages the paper in a region halfway between both friction drive means. Even better alignment can be obtained here if the roll is replaced by a ball, since the latter has point engagement against the sheet.

The paper alignment device in accordance with the invention can also be applied to typewriters with a platen feed, where the typing location is situated very close to the contact points between the platen and associated pressure rollers. If such a typewriter is automatically supplied with paper from a magazine, there similarly arises a need for automatically aligning a transferred sheet before writing starts. A braking means according to FIGS. 2 and 3 may suitably be placed in the paper magazine, alignment being effected such that a sheet is advanced in the typing direction past a typing start position for it, after which the advance of the sheet is reversed, with simultaneous activation of the braking means, until the paper has come out of engagement with the platen. Alignment then takes place in the same manner as described above.

What is claimed is:

1. Printing apparatus comprising a printing head, bidirectional friction feed means located upstream of said printing head, said bidirectional feed means serving as a means for feeding sheet material in a first direction to said printing head and therepast and for subsequently feeding said sheet material in a second direction, opposite to said first direction, past said printing head, said sheet material being printed as it is moved past said print head in said second direction, means to halt said feed means between reversal of feed direction, said sheet material having a length L, alignment means located downstream of said printing head for engaging said sheet material to align said sheet material, said alignment means being located at a distance D from said bidirectional friction feed means measured along the path of travel of said sheet material, said distance D being slightly less than said length L, the difference in said length L and said distance D constituting means to cause said sheet to slightly buckle subsequent to one end of said sheet engaging said alignment means and immediately prior to the other end of said sheet being disengaged from said bidirectional feed means at the termination of movement in said first direction, said buckling causing said other end of said sheet to be presented in an aligned condition to said bidirectional feed means so that when said bidirectional feed means is actuated in the second direction after being halted, said sheet is fed, properly aligned, to said printing head.

2. Apparatus as claimed in claim 1 wherein said alignment means comprises a fixed edge element extending at right angles to the direction of travel of the sheet material.

3. Printing apparatus comprising a printing head, bidirectional feed means located upstream of said printing head, said bidirectional feed means serving as a means for feeding sheet material in a first direction to said printing head and therepast and for subsequently feeding said sheet material in a second direction, opposite to said first direction, past said printing head, said sheet material being printed as it is moved past said print head in said second direction, means to halt said feed means between reversal of feed direction, said sheet material having a length L, alignment means located downstream of said printing head for engaging said sheet material to align said sheet material, said alignment means being located at a distance D from said bidirectional friction feed means measured along the path of travel of said sheet material, said distance D being less than said length L, said alignment means comprising a rotatable body and a spring member which biases said rotatable body, movement of said sheet material in said first direction causing said rotatable body to move against the bias of said spring member, the halting of said feed means occurring when said sheet material becomes disengaged from said feed means, said spring member and said rotatable body exerting a force on said sheet material in said second direction which causes said sheet material to be presented in an aligned condition to said bidirectional feed means so that when said bidirectional feed means is actuated in said second direction after being halted, said sheet is fed, properly aligned, to said printing head.

4. Apparatus as claimed in claim 3 wherein said rotatable body is supported for movement lengthwise of the advance of said sheet material in a wedge-shaped space for applying a braking force to the sheet material.

5. Apparatus as claimed in claim 4 comprising a paper chute for the sheet material, said chute including upper and lower walls arranged substantially horizontally, said rotatable body being supported in an aperture provided in one of said walls, said spring acting on said body to retain said body in said aperture and which forms the wedge-shaped space together with the other wall.

6. Apparatus as claimed in claim 5 wherein said rotatable body comprises a roll extending substantially at right angles to the advancing direction of the sheet material.

7. Apparatus as claimed in claim 5 wherein said rotatable body has the form of a ball.

8. Apparatus as claimed in claim 5 wherein said spring has one end secured to said wall at a location downstream of said aperture and a second free end, said spring bearing against said body to apply resilient braking force thereto upon advancing of the sheet material.

* * * * *